US005871671A

United States Patent [19]

Kinlen et al.

[11] Patent Number: 5,871,671

[45] Date of Patent: Feb. 16, 1999

[54] INTRINSICALLY CONDUCTIVE POLYMER/ PLASTICIZER BLENDS WITH ENHANCED CONDUCTIVITY

[75] Inventors: Patrick J. Kinlen, Fenton; Yiwei Ding; Vinod P. Menon, both of St. Louis, all of Mo.

[73] Assignee: Monsanto Company, St. Louis, Mo.

[21] Appl. No.: 950,574

[22] Filed: Oct. 14, 1997

[51] Int. Cl.[6] ..... H01B 1/00; H01B 1/12

[52] U.S. Cl. ..... 252/500

[58] Field of Search ..... 252/500; 528/210, 528/422

[56] References Cited

U.S. PATENT DOCUMENTS

| | | | |
|---|---|---|---|
| 4,615,829 | 10/1986 | Tamura et al. | 252/500 |
| 4,731,408 | 3/1988 | Jasne | 524/458 |
| 4,940,517 | 7/1990 | Wei | 204/78 |
| 5,112,450 | 5/1992 | Jasne | 204/59 R |
| 5,171,478 | 12/1992 | Han | 252/500 |
| 5,217,649 | 6/1993 | Kulkarni et al. | 252/500 |
| 5,232,631 | 8/1993 | Cao et al. | 252/500 |
| 5,264,474 | 11/1993 | Schleifstein et al. | 524/169 |
| 5,290,483 | 3/1994 | Kulkarni et al. | 252/500 |
| 5,324,453 | 6/1994 | Cao et al. | 252/500 |
| 5,494,609 | 2/1996 | Kulkarni et al. | 252/500 |
| 5,520,852 | 5/1996 | Ikkala et al. | 252/521 |
| 5,567,356 | 10/1996 | Kinlen | 252/500 |
| 5,585,038 | 12/1996 | Kirmanen et al. | 252/500 |
| 5,595,689 | 1/1997 | Kulkarni et al. | 252/500 |
| 5,720,903 | 2/1998 | Wessling et al. | 252/500 |
| 5,792,558 | 8/1998 | Jones et al. | 428/419 |

FOREIGN PATENT DOCUMENTS

| | | |
|---|---|---|
| 0 497 514 A1 | 1/1992 | European Pat. Off. . |
| 0 582 919 A2 | 7/1993 | European Pat. Off. . |
| WO 92/22911 | 12/1992 | WIPO . |

OTHER PUBLICATIONS

Angelopoulos et al., Polyaniline: Processability From Aqueous Solutions And Effect Of Water Vapor On Conductivity, Synthetic Metals, 21:21–30 (1987) no month.

Chen et al., Polyaniline Plasticized With 1–Methyl–2–Pyrrolidone; Structure And Doping Behavior, Macromolecules, 26:3254–3261 (1993) no month.

Chiang et al., Polyaniline: Protonic Acid Doping Of The Emeraldine Form To The Metallic Regime, Synthetic Metals, 13:193–205 (1986) no month.

Focke et al., Conduction Mechanisms In Polyaniline (Emeraldine Salt), J. Electroanal. Chem., 256:343–352 (1988) no month.

Genies et al., Polyaniline: A Historical Survey, Synthetic Metals, 36:139–182 (1990) no month.

Javadi et al., Conduction Mechanism Of Polyaniline: Effect Of Moisture, Synthetic Metals 26:1–8 (1988) no month.

Kahol et al., An Electron–Spin–Resonance Study Of Polyaniline And Its Derivatives: Polymer Interactions With Moisture, Synthetic Metals, 84:691–694 (1997) no month.

Laska et al., Solubilisation Ans Plastification Of Polyaniline In The Protonated State, Materials SCience Forum, 122:177–184 (1993) no month.

Laska et al., Phosphoric Acid Diesters Protonated Polyaniline: Preparation, Spectoscopic Properties, And Processability, J. Appl. Poly. Sci. Part A:Polymer Chemistry, 33:1437–1445 (1995) no month.

Laska et al., Rheological Behavior Of Plasticized Polyaniline, J. Appl. Poly. Sci., 61:1339–1343 (1996) no month.

(List continued on next page.)

*Primary Examiner*—Mark Kopec
*Attorney, Agent, or Firm*—Howell & Haferkamp, L.C.

[57] ABSTRACT

Organically soluble intrinsically conductive polymer compositions having enhanced electrical conductivity are produced by adding a hygroscopic, water-insoluble plasticizer to an organically soluble intrinsically conductive polymer salt. Polymer blends containing such compositions are also produced by blending a matrix polymer with the plasticizer/ICP salt compositions. Methods for enhancing the electrical conductivity of an organically soluble intrinsically conductive polymer salt provide for the addition of a hygroscopic, water-insoluble plasticizer to an organically soluble intrinsically conductive polymer salt.

48 Claims, 3 Drawing Sheets

OTHER PUBLICATIONS

Lee et al., Conductivity Relaxation of 1–Methyl–2–Pyrrolidone–Plasticized Polyaniline Film, Macromolecules, 28:7645–7652 (1995) no month.

Matveeva, Residual Water As A Factor Influencing The Electrical Properties Of Polyaniline. The Role Of Hydrogen Bonding Of The Polymer With Solvent Molecules In The Formation Of A Conductive Polymeric Network, Synthetic Metals, 79:127–139 (1996) no month.

Nechtschein et al., NMR Observation Of Proton Exchange In The Conducting Polymer Polyaniline, J. Physique, 47:935–937 (1986) no month.

Pron et al., Flexible, Highly Transparent, And Conductive Polyaniline–Cellulose Acetate Composite Films, J. Appl. Poly. Sci., 63:971–977 (1987) no month.

Shacklette et al., Dipole And Hydrogen–Bonding Interactions In Polyaniline: A Mechanism For Conductivity Enhancement, Synthetic Metals, 65:123–130 (1994) no month.

Timofeeva et al., Conducting Polymer Interaction With Gaseous Substances I. Water, Synthetic Metals, 40:111–116 (1991) no month.

INTRINSICALLY CONDUCTIVE POLYMER/ PLASTICIZER BLENDS WITH ENHANCED CONDUCTIVITY

BACKGROUND OF THE INVENTION (1) Field of the Invention

The present invention relates to intrinsically electrically conductive polymers and polymer blends and to methods for producing intrinsically electrically conductive polymers and polymer blends, and more particularly to such intrinsically conductive polymers and polymer blends having enhanced electrical conductivity, and to methods for producing such polymers and polymer blends having enhanced electrical conductivity.

(2) Description of the Related Art

Electrically conductive polymers are potentially extremely useful because of the combined properties of polymer processiblity coupled with electrical conductivity. It has been known for a long time that polymers can be made conductive by adding conducting additives like carbon black and metal particles but such additives are often highly colored, or opaque, and can also decrease the strength of the polymer.

More recently, it has been found that some polymers have appreciable electrical conductivity as an intrinsic property and can act as electrical conductors without the addition of conducting additives. Such polymers have been termed intrinsically conductive polymers (ICP's). Although many polymers have now been identified which act as ICP's, such polymers as polyaniline, polypyrrole, polythiophene, polyacetylene, and derivatives thereof, are characteristic. As used herein, the terms intrinsically conductive polymer, and ICP, will be understood to mean an organic polymer that contains polyconjugated bond systems and which can be doped with electron donor dopants or electron acceptor dopants to form a charge transfer complex that has an electrical conductivity of at least about $10^{-8}$ S/cm. Such doped ICP's will be referred to herein as the salts of intrinsically conductive polymers, or ICP salts. It will be understood that whenever an electrically conductive ICP is referred to herein, it is meant that the material is an ICP salt. Comprehensive reviews of ICP technology can be found in *Synthetic Metals,* vols. 17–19, 1987; vols. 28–30, 1989; and vols. 40–42, 1991.

Polyaniline has been of special interest due to its low cost, high stability under ambient conditions and capacity for being easily rendered conductive. Polyaniline occurs in at least four oxidation states: leuco-emeraldine, emeraldine salt, nigraniline and pernigraniline. Of these, the emeraldine salt form is the only electrically conductive state. In polyaniline, the presence or absence of a protonic acid dopant (counterion) can change the state of the polymer, respectively, from emeraldine salt to emeraldine base. Thus, the presence or absence of such a dopant can reversibly render the polymer conductive, or non-conductive. The use of protonic acids as dopants for ICP's such as polyaniline is well known and simple protonic acids such as HCl and $H_2SO_4$, or with functionalized organic acids such as para-toluenesulfonic acid (pTSA) or dodecylbenzenesulfonic acid (DBSA) results in the formation of conductive polyaniline.

Kahol et al., in *Synth. Met.,* 84:691–694, 1997, reported that it is well known that the electrical conductivity of protonated polyaniline is enhanced due to the presence of moisture. Although several theories have been proposed to explain this effect, the mechanism is not known. See, e.g., Chiang, J.-C. and A. G. MacDiarmid, *Synth. Met.,* 13:193, 1986; Angelopoulos, M. et al., *Synth. Met.,* 21:21, 1987; Nechtschein, M., and C. Santier, *J. Phys.,* 47:935, 1986; Focke, W. W., and G. E. Wnek, *J. Electroanal. Chem.* 256:343, 1988; Javadi, H. H. S. et al., *Synth. Met.,* 26:1, 1988; Timofeeva, O. N. et al., *Synth. Met.,* 40:111, 1991 and Shacklette, L. W., *Synth. Met.,* 65:123, 1994.

Although electrical conductivity is often a key property of the final product of an ICP, one drawback has been that ICP's in their conductive forms are often difficult to process. Earlier, for example, it was felt that polyaniline, in doped, or salt, form was insoluble in all organic solvents and in neutral form, was soluble only in highly polar solvents, such as N-methyl pyrrolidone. More recently it has been found that certain methods of synthesis, and the use of certain functionalized organic acid dopants, render electrically conductive polyaniline salt more soluble in non-polar organic solvents. See, e.g., U.S. Pat. No. 5,567,356, (use of hydrophobic counterions in emulsion polymerization with polar organic liquids) and WO 92/22911 and U.S. Pat. Nos. 5,324,453 and 5,232,631, (use of counterions having surfactant properties in emulsion polymerization with non-polar organic liquids). One potential drawback of polyaniline salts with high organic solubility can be the difficulty of providing sufficient moisture to the polyaniline to retain the desirably high electrical conductivity in highly organic systems.

In addition to solubility limitations of ICP's, melt processing of ICP's has also been difficult due to their tendency to destruct thermally prior to melting. Polymer blending has been tried, but conductivity is not always preserved, or may decrease to unacceptably low levels. Various additives such as surfactants, compatibilizers and/or plasticizers have been added to ICP's and blends to improve processibility and other mechanical properties, but many of these additives reduce the electrical conductivity. Consequently, recent experimentation has focused on ways to improve various processibility and mechanical properties of ICP's, while maintaining or improving the electrical conductivity.

For example, it is well known to use plasticizers in thermoset and thermoplastic polymers to improve the workability, flexibility, distensibility and/or impact resistance of the polymer during forming or in the final product. Plasticizers have also been added to ICP's to improve processibility. For example, Laska, J. et al., *J. Appl. Poly. Sci.,* 61:1339–1343, 1996, investigated the rheological behavior of polyaniline plasticized with diisooctyl phosphate. Chen, S.-A., and Lee, H.-T., *Macromolecules,* 26:3254–3261, 1993, reported the structure and doping behavior of polyaniline plasticized with 1-methyl-2-pyrrolidone (NMP). Later, the same group, Lee, H.-T. et al., *Macromolecules,* 28:7645–7652, 1995, reported the effect of NMP doping of polyaniline on the conductivity relaxation of films cast from the material.

U.S. Pat. No. 5,171,478, to Han, disclosed a method for increasing the molecular weight of polyaniline by a controlled heating process. It was reported that shorter heating times could be employed by including a plasticizer with the polyaniline. It was believed that the plasticizer increased intrachain mobility of the polyaniline and facilitated chain coupling reactions resulting in polyanilines of higher molecular weight. An extensive list of possible plasticizing agents was provided, including several organic acids well known as dopants for polyaniline, but the effect of such plasticizers on electrical conductivity was not reported.

European Patent Application Publ. No. 0582 919 A2 reported the use of metals complexed with protonic acids as compositions useful for neutralizing, plasticizing, lowering the percolation threshold of, and/or stabilizing polyanilines, or derivatives thereof, which had been doped with a protonic acid. The preferred composition, a zinc oxide—dodecylbenzenesulfonic acid (ZnO-DBSA) complex, was added to polyaniline doped with DBSA. Improved melt-processing properties and increased electrical conductivity were reported for such materials and for blends with thermoplastics. However, large amounts of organic acids were used to form the subject compositions, since high levels of acids were used in both the acid-doped polyaniline and in the metal-acid complex.

In U.S. Pat. No. 5,217,649 and EP 497 514 A1, Kulkarni et al., reported the formation of conductive polymer blends containing an ICP and a thermoplastic polymer along with an acidic surfactant and from about 1% wt/wt to about 40% wt/wt of a highly polar, ester-free plasticizer such as a sulfonamide. In blends with polyvinylchloride and a sulfonamide plasticizer, polyaniline added from about 5% wt/wt to about 50% wt/wt of the blend resulted in a concommitant increase in electrical conductivity of the blend. A maximum conductivity of about 10 S/cm was reached at a polyaniline level of about 33% and a sulfonamide level of about 17%. The reference did not mention the moisture level of the compositions or the organic solubility of the polyaniline.

Later, in U.S. Pat. No. 5,290,483, the same group of investigators disclosed a process for producing a conductive polymer article. In one example, a sulfonamide plasticizer was used as an additive to polyaniline along with carbon black, chlorinated polyethylene, an organic surfactant and a stabilizer. As before, however, the moisture level of the compositions was not mentioned.

More recently, Kulkarni et al., in U.S. Pat. No. 5,595,689, taught the production of conductive ICP blends that contained non-polymeric polar additives such as sulfonamides in general and N-butylbenzene sulfonamide in particular. All ICP blends were produced with the highly polar polyaniline, VERSICON®, that is known to have low solubility in non-polar organic liquids. No examples indicate the processibility of the products in organic solvents and no mention was made of methods to retain moisture in the processed materials.

The addition of surfactants, plasticizers and other processing aids to ICP blends with thermoplastic and thermosetting resins was mentioned in U.S. Pat. No. 5,494,609, but the purpose of such additives was to improve the dispersion and film forming properties of the polymer dispersions rather than to modify the conductivity. Highly polar plasticizers such as sulfonamides, phosphate and benzoate esters were reported to be preferred for use with ICP blends with thermoplastics, but with the purpose of producing optimum film forming quality. However, Pron, A. et al., *J. Appl. Polym. Sci.,* 63:971–977, 1997, disclosed that a mixture of phthalic and phosphoric acid esters improved the flexibility and also the conductivity of films cast from protonated polyaniline blends with cellulose acetate in m-cresol solutions. The addition of plasticizers significantly lowered the percolation threshold of the polyaniline/cellulose acetate blends. The polyaniline used in the study had been synthesized by standard aqueous oxidative polymerization and the emeraldine base was subsequently doped with such protonating agents as, camphor sulfonic acid, phenyl-phosphonic acid, dibutyl phosphate, dioctyl phosphate and diphenyl phosphate. However, the resulting polyaniline salt demonstrated a maximum solubility in m-cresol of less than 0.5% and solubility in such non-polar solvents as xylene would probably have been significantly lower.

Laska, J. et al., *Materials Science Forum,* 122:177–184, 1993, reported that the solubilization and plastification of polyaniline in the protonated state was improved by the addition of di-alkyl phosphate esters. Esters such as diisoctyl hydrogen phosphate and diisobutyl hydrogen phosphate served to protonate the polyaniline as well as to serve as plasticizers. Although the plasticized compounds were termed soluble in common solvents, the highest solubility in toluene or decalin was apparently under 10% wt/wt. Polyanilines complexed with such aliphatic esters, however, did not include any acid salts.

Later, the same group, Laska, J., et al., *J. Polym. Sci.: Part A: Polym. Chem.,* 33:1437–1445, 1995, expanded the types of phosphoric acid diesters studied. Again it was reported that the diesters protonated the polyaniline base as well as served to plasticize the complex. But, again none of the aliphatic phosphate diester-plasticized compounds were the acid salts of ICP's. It was stated that the phosphoric acid diesters act as efficient polyaniline solubilizing agents and that diester protonated polyanilines readily dissolved in solvents such as toluene and xylene, but no level of solubility was given for these materials.

Ikkala et al., U.S. Pat. No. 5,520,852, found that non-functional acids, such as hydrochloric acid and $H_2SO_4$, can be used as counter-ions for polyaniline complexes and polymer blends if certain organic cyclic compounds are also present. They disclosed that such organic cyclic compounds work as solvent-plasticizers in doped polyanilines where the doping counter-ion is not functionalized, and as compatibilizers where polyaniline is blended with another polymer. The organic cyclic compounds are disclosed to be sulfonamides or molecular recognition compounds capable of bonding with the six-membered rings of the polyaniline salt complexes. Since the purpose of the organic cyclic compounds was to facilitate the use of non-functional, protonic acids, such compounds were not added to polyanilines having functional organic acid dopants. No mention was made of the desirability or effect of moisture level in the compositions.

In U.S. Pat. No. 5,585,038, to Kirmanen et al., a method was disclosed for preparing an electrically conductive doped polyaniline compound which contained the polyaniline, a doping acid such as DBSA, a metal compound such as zinc oxide, a base such as calcium carbonate and a plasticizing agent such as water, $C_1$–$C_3$ alcohols and mixtures thereof. Such compound was reported to have low acidity, be easily processible at elevated temperatures and to be electrically conductive. Despite the addition of water, or low boiling alcohols, at the initial stage of forming the mixture, the final composition as manufactured would not contain a significant amount of such volatile plasticizing component because high temperatures employed during a subsequent melt-mixing step cause them to be driven off. The moisture level in the final composition was not disclosed to be important to the properties of the composition.

Although it is known that the electrical conductivity of ICP's, and especially polyaniline, can be enhanced by increasing the moisture level in the composition, no method is available to obtain enhanced levels of conductivity in ICP compositions having high organic solubility and to retain the enhanced level of conductivity under conditions that leach out water soluble components. Methods to maintain such enhanced conductivity, while at the same time enhancing the processibility and mechanical properties of such organically soluble ICP's, would be extremely useful for the production of ICP's and polymer blends containing ICP's having high organic solubility, improved mechanical properties and enhanced electrical conductivity.

SUMMARY OF THE INVENTION

Briefly, therefore, the present invention is directed to an organically soluble intrinsically conductive polymer composition having enhanced electrical conductivity comprising an organically soluble intrinsically conductive polymer salt and a conductivity-enhancing amount of a hygroscopic, water-insoluble plasticizer that is compatible with the intrinsically conductive polymer salt.

The present invention is also directed to a polymer blend having enhanced electrical conductivity comprising a composition as set forth above and a matrix polymer.

Furthermore, the present invention is also directed to a method for enhancing the electrical conductivity of an organically soluble intrinsically conductive polymer salt, comprising mixing with such organically soluble intrinsically conductive polymer salt a conductivity-enhancing amount of a hygroscopic, water-insoluble plasticizer that is compatible with the intrinsically conductive polymer salt, thereby enhancing the electrical conductivity of said organically soluble intrinsically conductive polymer salt.

Among the several advantages found to be achieved by the present invention, therefore, may be noted the provision of organically soluble, electrically conductive compositions containing ICP's having improved mechanical properties, but also having enhanced electrical conductivity as well; the provision of such compositions containing ICP's in blends with other polymers, wherein the blends have improved mechanical properties and also have enhanced electrical conductivity; the provision of such compositions having enhanced electrical conductivity that retain such enhanced conductivity after immersion in water and the provision of methods for the production of such compositions.

DETAILED DESCRIPTION OF THE PREFERRED EMBODIMENTS

Figure 1:
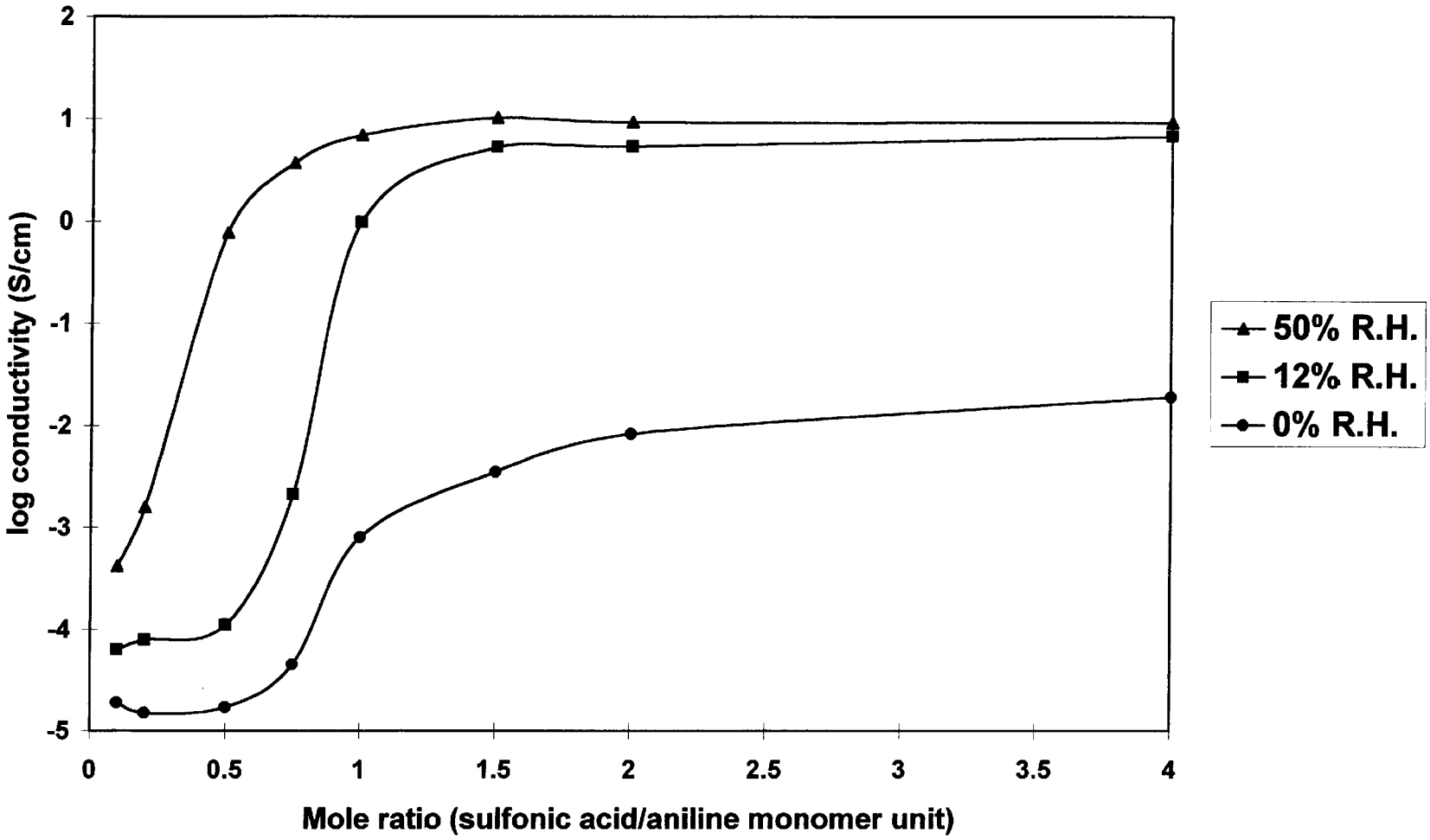
FIG. 1 is a plot of electrical conductivity versus sulfonic acid:aniline monomer unit ratio for thin films of the dinonylnaphthalenesulfonic acid salt of polyaniline to which varying levels of dodecylbensenesulfonic acid have been added and the films have been equilibrated at three levels of relative humidity.

In accordance with the present invention, it has been discovered that intermixing a hygroscopic, water-insoluble plasticizer with an organically soluble ICP salt produces an organically soluble ICP salt composition having surprisingly enhanced eletrical conductivity. In fact, the conductivity of compositions of the present invention has been found to be several orders of magnitude higher than the conductivity of similar compositions lacking only a preferred plasticizer; indeed, conductivities of up to 25 S/cm have been measured. Furthermore, conventional compositions without plasticizers lose a significant portion of their dopant acids upon contact with water, which causes the loss of mechanical strength of films cast from such compositions and can ultimately reduce the conductivity of such similar compositons. By contrast, compositons of the present invention have retained their enhanced conductivity even after having been soaked in water for up to 24 hours. Such organically soluble ICP salt compositions of enhanced electrical conductivity can also be mixed with a matrix polymer to produce polymer blends of enhanced electrical conductivity.

The plasticizers of this invention can be used to provide not only enhanced electrical conductivity, but other benefits as well. For example, the plasticizer can improve the mechanical properties of the organically soluble ICP salts, which has been shown to permit the formation of films of the organically soluble ICP salt compositions—and films of polymer blends containing the ICP salt compositions—that are self-supporting and flexible.

The Intrinsically Conductive Polymer

A number of ICP's that are suitable for the purpose of this invention are known in the art and include, for example, polyaniline, polyacetylene, poly-p-phenylene, poly-m-phenylene, polyphenylene sulfide, polypyrrole, polythiophene, polycarbazole and the like. Such ICP's are well known and those of ordinary skill in the art will readily recognize those ICP's that are within the scope of this invention.

In general, polyanilines suitable for use in this invention are homopolymers and copolymers derived from the polymerization of unsubstituted or substituted anilines of Formula I:

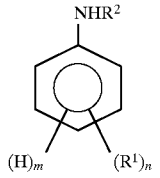

Formula I wherein:

n is an integer from 0 to about 2;

m is an integer from 2 to 5, provided that the sum of n and m is equal to 5;

$R^1$ is an aryl, alkyl or alkoxy group having up to about 30 carbon atoms, cyano, halo, acid functional groups, such as the functional groups of sulfonic acid, carboxylic acid, phosphonic acid, phosphoric acid, phosphinic acid, boric acid and sulfinic acid, derivatives of such acid functional groups, such as salts, esters and the like, amino, alkylamino, dialkylamino, arylamino, hydroxy, diarylamino, alkylarylamino, or an alkyl, aryl or alkoxy group substituted with one or more acid functional groups, such as those noted above, or derivatives of such acid functional groups, such as salts, esters, and the like; and $R^2$ is hydrogen or is selected from the same group of substituents as set forth for $R^1$. Particularly preferred for use in this invention is the polyaniline produced from homopolymerization of unsubstituted aniline.

Polyanilines suitable for use in this invention are generally those which consist of repeating units of the Formulas II and/or III, or a combination thereof having various ratios of the above repeating units in the polyaniline backbone, wherein n, m, $R^1$ and $R^2$ are as defined above and z is an integer equal to or greater than about 10, recognizing, however, that while the units are referred to as "repeating", more than one aniline may be used and so while the general formula for each of the units may be identical, each of n, m, $R^1$ and $R^2$ need not be the same from one unit to the next, and especially $R^2$ may be different at various occurrences (although in certain preferred embodiments the polyaniline is a homopolymer and so each of the n's, m's, $R^1$'s and $R^2$'s would be the same from unit to unit, and in the most preferred embodiment, m is 5, n is 0 and each $R^2$ is hydrogen):

Formula II

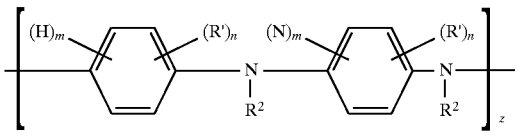

Formula III

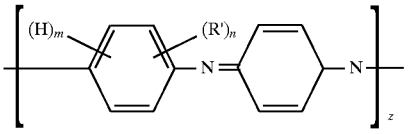

Illustrative of preferred polyanilines are those of Formulas IV and V:

Formula IV

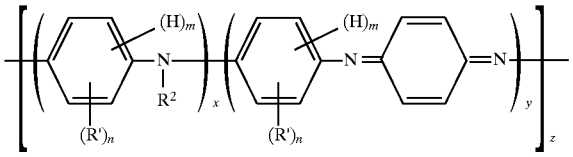

Formula V

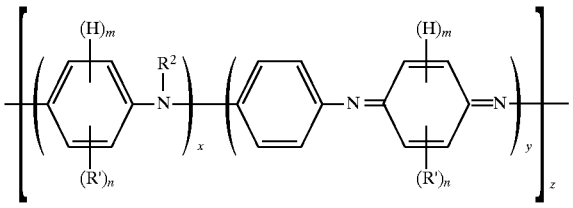

wherein:

n is 0 or 1;

m is 3 or 4, with the sum of n and m equal to 4;

$R^1$ is alkyl of from 1 to about 20 carbon atoms, carboxyl, sulfonyl, sulfinyl, phosphinyl, or phosphonyl;

$R^2$ is methyl, ethyl, carboxyl, sulfonyl, phosphinyl, phosphonyl, sulfinyl, phosphonyl, or hydrogen;

x is an integer equal to or greater than 2; and y is a positive integer, provided that the ratio of x to y is greater than 1; and z is an integer equal to or greater than about 10.

In the more preferred embodiments of this invention, the ICP is polyaniline derived from aniline or N-alkylaniline either unsubstituted or substituted with at least one sulfonyl, alkyl or alkoxy. The most preferred ICP is polyaniline is polyaniline derived from unsubstituted aniline.

The ICP can be synthesized by any method that results in the production of an organically soluble ICP. For example, the ICP can be synthesized by chemical oxidative polymerization of an ICP monomer or by electrochemical polymerization. Such methods are well known in the art and are described by, for example, Genies, E. M., et al., *Synth. Met.*, 36:139–182, 1990, and U.S. Pat. Nos. 4,615,829, 4,731,408, 4,940,517 and 5,112,450.

ICP's can exist in either the base or salt form, but the salt form of ICP's usually have much higher electrical conductivities than the base form and are therefore preferred for the present invention. ICP salts can be formed by contacting an ICP with a protonic acid and an oxidant. Alternatively, the dopant of a doped ICP can be replaced by contacting the ICP salt with a different dopant acid. While such acids as $H_2SO_4$ and hydrochloric acid may be used, the ICP salts that are formed from these mineral acids are usually insoluble in almost all solvents. Therefore, dopant acids that have larger, organically soluble counter-ions are used in order to provide the ICP salt a greater degree of solubility in organic solvents.

Preferred organically soluble ICP salts can be produced by the emulsion polymerization methods described in U.S. Pat. No. 5,567,356 and U.S. patent application Ser. No. 08/596,202, both of which are incorporated herein by reference. Such preferred organically soluble ICP salts are produced by chemical or electrochemical oxidative polymerization of ICP monomers using emulsion polymerization in the presence of water and an organic solvent in which water is soluble in an amount of at least about 6% wt/wt, or greater. The organically soluble ICP salts that result from these methods have high solubility in non-polar and weakly polar organic solvents and are of high molecular weight.

The preferred organically soluble ICP salt is an organically soluble ICP salt of a hydrophobic organic acid. As used herein, the phrase "organically soluble ICP salt" means any ICP that is doped with a protonic acid and has a solubility in xylene of at least about 15% wt/wt, or greater. Preferably the solubility in xylene is about 20% wt/wt, or greater, more preferably about 25% wt/wt, or greater, and most preferably about 30% wt/wt, or greater.

The presence of a hydrophobic counter-ion of an organic acid is believed to cause the dopant to be substantially retained in the composition and not to be leached out of the composition during immersion in water. By "hydrophobic organic acid", what is meant is that the organic acid is soluble in water in an amount of less than about 1% wt/wt. Preferably the water solubility of the organic acid is less than about 0.5% wt/wt.

The hydrophobic organic acid can be a hydrophobic sulfonic acid, hydrophobic carboxylic acid, hydrophobic sulfonate, hydrophobic sulfinic acid, hydrophobic phosphinic acid, hydrophobic phosphonic acid, the salts of such acids, or a mixture thereof. Preferred hydrophobic organic acids are hydrophobic sulfonic acids. The most preferred hydrophobic organic acid is dinonylnaphthylenesulfonic acid.

The Plasticizer

As explained above, in the present invention a plasticizer is mixed with the organically soluble ICP salt. Plasticizers that are suitable for use in the subject composition are those that are hygroscopic and water-insoluble. Preferred plasticizers are compatible with solutions of the organically soluble ICP in organic solvents and increase the electrical conductivity of the ICP salt when they are added to the ICP salt in a conductivity enhancing amount, as those terms are defined below.

When the term "hygroscopic" is used herein to describe the plasticizer, it is meant that the plasticizer readily absorbs and retains water. Such water sometimes will be referred to herein as "moisture". A hygroscopic plasticizer can be selected according to a simple test for hygroscopicity. For example, the test may comprise removing moisture from a sample of a plasticizer by heat, vacuum, contact with a desiccant, or some combination of these, until no more moisture is removed from the sample (a plasticizer that indicates no further moisture loss under such desiccating conditions is considered to have zero moisture content), placing a specimen of known weight of the plasticizer with zero moisture content into an atmosphere of controlled humidity for a pre-determined period of time, and then weighing the specimen to determine the amount of moisture the specimen absorbed. By way of illustration, samples of commercial plasticizers Uniplex®-108 (a trade name designation of the Unitex Corporation for o,p-N-ethyl-p-toluenesulfonamide) and Uniplex®-214 (a trade name designation of the Unitex Corporation for N-butyl benzenesulfonamide) were dried at 0% relative humidity (R.H.) for 24 hrs. Weighed samples of each dried plasticizer were placed in a chamber controlled at 50% R.H. for 3 days and re-weighed to determined moisture gain. Moisture gain is calculated by subtracting the weight of the dried plasticizer sample before exposure to moisture from the weight of the sample after such exposure to moisture. The percent moisture increase was calculated as 100 times the moisture gain divided by the weight of the dried plasticizer before exposure. The percent moisture increase for Uniplex®-108 was 0.4% and for Uniplex®-214 was 0.6%.

A "hygroscopic plasticizer", as that term is used herein, means a plasticizer that has a percent moisture increase of at least about 0.05% in 3 days at room temperature and 50% R.H.. Preferred hygroscopic plasticizers have a percent moisture increase as measured by the test described above of between about 0.05% and about 4%, the percent moisture increase of more preferred hygroscopic plasticizers is between about 1% and about 2%, and most preferred hygroscopic plasticizers have a percent moisture increase between about 0.2% and about 1.2%.

Despite being hygroscopic, however, the plasticizer is one that is water-insoluble. When the plasticizer is referred to as being "water-insoluble", it is meant that the plasticizer is not soluble in water in any amount more than about 1% wt/wt. Preferably, the solubility of the plasticizer in water is less than about 0.5% wt/wt, most preferably less than about 0.1% wt/wt.

Preferred plasticizers are acidic or neutral, rather than basic. An acidic or neutral ionic character permits the plasticizer to remain in the composition with the doped ICP salt without neutralizing the dopant acid.

A preferred plasticizer increases the electrical conductivity of the organically soluble ICP salts described above when the plasticizer is mixed with the ICP salt in a conductivity-enhancing amount. The term, "conductivity-enhancing amount", when used to describe the amount of the plasticizer added to the organically soluble ICP salt composition, means an amount that, when mixed with the ICP salt under conditions in which the resulting ICP salt composition contains an amount of moisture that is in equilibrium with an atmosphere of 50% relative humidity or more, increases by a factor of two or greater the electrical conductivity of the composition over that of a similar composition without the plasticizer. Preferably the hygroscopic, water-insoluble plasticizer increases the electrical conductivity by a factor of four or greater, more preferably by one order of magnitude or greater, even more preferably by two orders of magnitude or greater and most preferably by three orders of magnitude or greater when the plasticizer is mixed with the ICP salt composition under conditions where the ICP salt composition contains an amount of moisture that is in equilibrium with an atmosphere of 50% relative humidity, or greater. When it is said that the conductivity is increased by a factor of two or greater, it is meant that if, for example, the conductivity of an ICP composition without the plasticizer is about $2\times10^{-2}$ S/cm, the conductivity is raised to at least about $4\times10^{-2}$ S/cm upon addition of the plasticizer. For an illustration of what is meant when it is said that the conductivity is increased by one order of magnitude or greater, if, for example, the conductivity of the ICP composition without the plasticizer is about $10^{-4}$ S/cm, the conductivity is raised to at least about $10^{-3}$ S/cm upon addition of the plasticizer.

The preferred plasticizer is compatible with the ICP salt in solution in an organic solvent. As used herein to describe the interaction of a plasticizer with an ICP salt in solution, the term "compatible" means that the plasticizer is one that, when added in a conductivity-enhancing amount to a 15% wt/wt solution of an organically soluble intrinsically conductive polymer salt in xylene, results in the intrinsically conductive polymer salt remaining in solution without precipitating. Such compatibility between the plasticizer and the ICP salt is advantageous because certain of the preferred organically soluble ICP salt compositions of commercial importance can be supplied as solutions of the ICP salt in non-polar or weakly polar carrier solvents such as xylene. Such solutions can have ICP salt concentration of up to about 40% wt/wt, or higher. Preferred plasticizers do not cause the organically soluble ICP salt to precipitate from a xylene solution when a conductivity-enhancing amount of the plasticizer is added to such solution. Another advantage of this solution compatibility is that the plasticizer can be blended into the ICP salt solution so that the ICP salt and the plasticizer are well-mixed.

Selecting a plasticizer that has the required properties of hygroscopicity and water-insolubility and the preferred properties of compatibility and acidic or neutral ionic character, is important in order to obtain the various benefits of the invention. Although the inventors do not wish to be limited to any particular theory, the hygroscopicity of the plasticizer is thought to cause the attraction and retention of moisture to the composition, which is believed to increase the degree of interchain mobility and facilitate charge transfer and to result in enhanced electrical conductivity. The water-insolubility of the plasticizer is believed to prevent leaching of the plasticizer from the composition upon immersion or contact with water. Loss of conductivity during water exposure of similar compositions that did not use a plasticizer of the present invention was reported by Kulkarni et al., U.S. Pat. No. 5,494,609, upon soaking plasticized ICP blends in water. Plasticized ICP/thermoplastic polymer blends were soaked in water and higher surface resistance (lower conductivity) was reported in three out of four cases. In the remaining case, in which a hydrophobic thermoplastic matrix polymer was used, the conductivity increased from 0.01 S/cm to 0.03 S/cm. Thus, it was reported that the preferred composition included thermoplastics that were hydrophobic and resistant to water, but no hygroscopicity or solubility requirements were disclosed for the plasticizers or the dopant used in the compositions.

Illustrative of plasticizers that are useful in the present invention are certain mono-sulfonamides and bis-sulfonamides. The mono-sulfonamides useful as plasticizers in this invention contain from 7 to 30 (preferably 8 to 24) carbon atoms, one sulfur atom, one nitrogen atom, an aromatic group bonded to the sulfur atom (wherein one or more other substituent groups may be bonded to the aromatic group), and one or two organic groups (e.g., aliphatic, cycloaliphatic or aromatic groups having a total of no more than about 24 carbon atoms) bonded to the nitrogen atom. The bis-sulfonamides useful as plasticizers in this invention are aromatic bis-sulfonamides containing at least two (preferably two or three) aromatic rings and from 14 to 30 (preferably 18 to 24) carbon atoms. Preferred substituent groups for the aromatic group bonded to the sulfur atom are hydrogen; alkyl groups having from one to 12 carbon atoms; saturated or unsaturated aromatic groups having from 5 to 10 carbon atoms such as benzyl, naphthyl, xylyl, or cyclopentyl; halogen; hydroxyl, sulfate, nitrate, or borate. Mixtures of mono-sulfonamides and bis-sulfonamides may be used as plasticizers. Thus, if desired, mixtures of any one or more mono-sulfonamides with any one or more bis-sulfonamides may also be used as plasticizers.

Among the mono-sulfonamides useful in this invention are those represented by the general formula

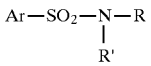

wherein Ar is a substituted or unsubstituted aromatic group, R is a hydrocarbon group, and R' is a hydrogen atom, a hydrocarbon group or a substituted or unsubstituted aromatic group. Where aromatic groups are substituted, preferred substituent groups are alkyl groups having from one to 12 carbon atoms; saturated or unsaturated aromatic groups having from 5 to 10 carbon atoms such as benzyl, naphthyl, xylyl, or cyclopentyl; halogen; hydroxyl, sulfate, nitrate, or borate.

One preferred type of mono-sulfonamide to be utilized pursuant to this invention may be represented by the general formula

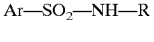

wherein Ar is a substituted or unsubstituted aromatic group and R is a hydrocarbon or substituted or unsubstituted aromatic group. Where aromatic groups are substituted, preferred substituent groups are alkyl groups having from one to 12 carbon atoms; saturated or unsaturated aromatic groups having from 5 to 10 carbon atoms such as benzyl, naphthyl, xylyl, or cyclopentyl; halogen; hydroxyl, sulfate, nitrate, or borate.

Illustrative of some of the types of mono-sulfonamide plasticizers useful in the practice of this invention include N-methyl-benzenesulfonamide, N-ethyl-benzenesulfonamide, N-butyl-benzenesulfonamide, N-octyl-benzenesulfonamide, N-decyl-benzenesulfonamide, N-dodecylbenzenesulfonamide, N-isopropyl-benzenesulfonamide, N-pentyl-benzenesulfonamide, N-heptyl-benzenesulfonamide, N-nonyl-benzenesulfonamide, N-undecyl-toluenesulfonamide, N-cyclohexyl-benzenesulfonamide, N-cyclooctyl-xylenesulfonamide, N-phenyl-benzenesulfonamide, N-phenyl-trimethylbenzenesulfonamide, N-tolyl-butylbenzenesulfonamide, N-phenyl-phenyl-benzenesulfonamide, N-biphenyl-xylenesulfonamide, N-1-naphthyl-benzenesulfonamide, N-1-tetrahydronaphthyl-benzenesulfonamide, N-9-anthracenyl-benzenesulfonamide, N-propyl-benzenesulfonamide, N-hexyl-benzenesulfonamide, N-tert-butyl-benzenesulfonamide, N-triphenyl-benzenesulfonamide, N-cyclohexyl-toluenesulfonamide, N,N-dimethyl-benzenesulfonamide, N,N-dibutyl-benzenesulfonamide, N-methyl-N-octyl-benzenesulfonamide, N,N-diphenyl-benzenesulfonamide, N,N-dicyclohexyl-benzenesulfonamide, N,N-diphenyl-xylenesulfonamide, N-cyclopentyl-N-octyl-phenylcarbinylbenzenesulfonamide, N,N-dinonyl-benzenesulfonamide, N-methyl-N-1,2,3,4-tetrahydro-1-naphthyl-benzenesulfonamide, and o,p-N-ethyl-p-toluenesulfonamide. Of these mono-sulfonamide plasticizers, N-butyl-benzenesulfonamide and o,p-N-ethyl-p-toluenesulfonamide are preferred.

Among the aromatic bis-sulfonamides useful in this invention are those represented by the general formula

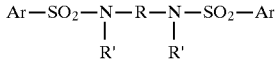

wherein Ar's are the same or different and are substituted or unsubstituted aromatic groups, R is a divalent hydrocarbon or halohydrocarbon group, and R' is as defined above, but R' does not have to be the same at each occurrence in a bis-sulfonamide and can be the same or different. Where aromatic groups are substituted, preferred substituent groups are alkyl groups having from one to 12 carbon atoms; saturated or unsaturated aromatic groups having from 5 to 10 carbon atoms such as benzyl, naphthyl, xylyl, or cyclopentyl; halogen; hydroxyl, sulfate, nitrate, or borate.

A few illustrative bis-sulfonamide plasticizers useful in the practice of this invention include N,N'-p-cyclohexylenebis(benzenesulfonamide), N,N'-o-phenylenebis(benzenesulfonamide), N,N'-p-phenylenebis(benzenesulfonamide), N,N'-hexamethylenebis(benzenesulfonamide), N,N'-ethylenebis(benzenesulfonamide) and N,N'-p-phenylenebis(benzenesulfonamide).

Methods for the preparation of mono-sulfonamides and bis-sulfonamides useful in the present invention are well known and are reported in the literature. For further information, see, e.g., U.S. Pat. No. 5,264,474, to Schleifstein et al, incorporated herein by reference.

Production of the ICP/Plasticizer Composition

The compositions of the present invention may be prepared simply by mixing a hygroscopic, water-insoluble plasticizer with an organically soluble ICP salt and thereby forming an organically soluble ICP salt composition having enhanced electrical conductivity. The hygroscopic, water-insoluble plasticizer is mixed with the organically soluble ICP salt by any common method to form the ICP salt composition of this invention. The methods of addition and mixing are not critical, but it is preferred that the plasticizer be distributed evenly throughout the ICP salt. It is more preferred that the plasticizer be homogeneously mixed with the ICP salt on a molecular basis.

One suitable method for adding the plasticizer to the ICP salt is to form a solution containing the hygroscopic, water-insoluble plasticizer and the organically soluble intrinsically conductive polymer salt in a solvent, to mix the solution thoroughly and to remove all or part of the solvent. Alternately, each of the components may be put in separate solutions and then the solutions mixed together. Removal of the solvent then would produce a homogeneous blend of the plasticizer and the ICP salt. Reference herein to the plasticizer and/or the ICP salt being in solution is meant to include mixtures such as dispersions or emulsions, as well as molecular solutions.

While such solution-mixing is a preferred method of forming the present compositions, it is not required in order to produce the benefits of the present invention. The plasticizer can simply be mixed with the ICP salt by any common polymer blending technique such as, for example, single or twin-screw extruder, Brabender mixer, kneader-mixer, roll-mill, or any other mixing technique suitable for mixing high viscosity materials.

Alternatively, the plasticizer can be added as a component to the polymerization medium before or during oxidative polymerization of the ICP. In this manner, the ICP is formed in the presence of the plasticizer.

The composition of the invention, therefore, contains an organically soluble ICP salt and a hygroscopic, water-insoluble plasticizer that is preferably present in at least a conductivity-enhancing amount. The composition can also contain other components. For example, in a preferred embodiment, the composition of the present invention contains water. This water content will be referred to herein as "moisture". It is especially preferred that the composition contain a conductivity-enhancing amount of moisture. By "conductivity-enhancing amount of moisture", what is meant is an amount of moisture sufficient to cause the electrical conductivity of a composition to be at least 25% greater than the conductivity of a similar composition that differs from the first only in that it lacks the moisture.

Moisture can be added to the composition in any known manner. Water can be blended with the composition, or with any component of the composition, at any step in the preparation of the composition. Alternately, the compositions of the present invention can be exposed to an atmosphere containing moisture, as in, for example, a humidity chamber, for a time sufficient for the moisture level of the compositions to come to equilibrium with the moisture level in the surrounding atmosphere. Thus, the conductivity-enhancing amount of moisture in the composition can be expressed in terms of an amount of moisture that would be sufficient to bring the moisture content of the composition to that which would be in equilibrium with a particular relative humidity. In the preferred compositions, the amount of moisture is an amount sufficient to bring the moisture content of the composition to that which would be in equilibrium with 10% relative humidity or greater, or more preferably with 20% relative humidity or greater, or even more preferably with 30% relative humidity or greater, or most preferably with 50% relative humidity or greater. Of course, the subject compositions are useful even when they do not possess a conductivity-enhancing amount of moisture, because a change in the moisture content of the environment, such as a change in relative humidity, will cause such amount of moisture to be taken up by the compositions, thus re-establishing their enhanced conductivity. In fact, such reversible change in conductivity in response to moisture content could be used in such applications as an electric switch that is moisture-sensitive.

If desired, a non-ICP polymer, that can be termed a "matrix" polymer, can be added to this mixture either as a solid or in solution, to form a polymer blend with the ICP salt/plasticizer composition. For the purposes of this invention, the type of matrix polymer used is not critical and the matrix polymer can be almost any thermoset or thermoplastic resin or polymer, or mixtures thereof, that is, or can be made to be, compatible with the organically soluble ICP salt composition. It is well known that certain polymers which would not otherwise be compatible, can be made compatible for the purpose of blending, by the addition of compatibilizers. A preferred thermoplastic matrix polymer is a thermoplastic phenoxy resin. A preferred thermoset matrix polymer is an epoxy resin.

If a matrix polymer is to be added to the ICP to form a polymer blend, the matrix polymer may be added at any time before, during, or after the formation of the plasticizer/ICP salt composition. The matrix polymer can be any polymer that is compatible with the ICP composition and that contributes desirable properties to the blend, such as, for example, improved tensile properties or improved processiblity.

A compatibilizer and/or any other additives may also be intermixed with the other components at any point during production. One useful method for the intermixing of a matrix polymer is to intermix a solution of the matrix polymer with an ICP salt solution, or a solution of the plasticizer, or with a solution containing both ICP salt and plasticizer with subsequent removal of the solvents from the blend.

The organically soluble ICP compositions and the polymer blend compositions can be made in the form of liquids or solids and can be mixed with solvents or other materials as is desirable for processing or final application. Materials resulting from these compositions can be in the form of films, fibers, cast parts, rods and almost any other useful form. Such materials, in any of such forms, are intended to be included within the scope of the claimed invention.

One embodiment of the compositions of the present invention is an organically soluble ICP composition having enhanced electrical conductivity. When the composition is described as having "enhanced electrical conductivity", it is meant that the conductivity of the composition is higher than that of a similar ICP that lacks only the hygroscopic, water-insoluble plasticizer. In fact, the conductivity of the compositions of the present invention has been shown to be up to five orders of magnitude higher than the conductivity of compositions lacking only the preferred plasticizer. Likewise, when the term "enhanced electrical conductivity" is used to describe a polymer blend embodiment of the present invention, it is meant that the polymer blend has a higher conductivity than that of a similar polymer blend that lacks only the hygroscopic, water-insoluble plasticizer.

The electrical conductivity of the compositions of the present invention, whether ICP compositions or polymer blends, are preferably at least about $10^{-6}$ S/cm, or higher; or more preferably at least about $10^{-4}$ S/cm, or higher; or even more preferably at least about $10^{-2}$ S/cm, or higher; or most preferably at least about 1 S/cm, or higher.

Another important advantage of the present compositions that has been found is that the water-insoluble plasticizer is not leached out of the compositions by immersion in water. This is important for the application of the compositions, for example, in fibers for textile use, where repeated washings may be necessary. Therefore, in the preferred embodiments, the hygroscopic, water-insoluble plasticizer is substantially retained in the organically soluble intrinsically conductive polymer composition having enhanced electrical conductivity after immersion of said composition in water at ambient temperature for 24 hours. When it is said that the plasticizer is substantially retained, it is meant that a conductivity-enhancing amount of the plasticizer is retained in the composition. Preferably, the electrical conductivity of the organically soluble intrinsically conductive polymer composition having enhanced electrical conductivity is not significantly diminished after immersion in water at room temperature for 24 hours.

The following examples describe preferred embodiments of the inventions. Other embodiments within the scope of the claims herein will be apparent to one skilled in the art from consideration of the specification or practice of the invention as disclosed herein. It is intended that the specification, together with the examples, be considered exemplary only, with the scope and spirit of the invention being indicated by the claims which follow the examples.

REFERENCE EXAMPLE 1

This example illustrates the effect of moisture level on conductivity in a polyaniline doped with dinonylnaphthalenesulfonic acid and dodecylbenzenesulfonic acid.

Dinonylnaphthalenesulfonic acid (DNNSA) salt of polyaniline, as produced by the emulsion polymerization method of U.S. Pat. No. 5,567,356, (PANDA), was used to prepare a 10% wt/wt solution in xylene. PANDA produced by this method has high solubility in non-polar or weakly polar organic solvents. Dodecylbenzenesulfonic acid (DBSA) was added to this solution to give solutions with ratios of the sulfonic acid-to-aniline monomeric units varying from 0.1:1 to 4:1. The solutions were clear green with no signs of precipitation and could easily be filtered through 0.2 micron Teflon® syringe filters. Thin films of these solutions were cast spanning two gold electrodes, 1 mm apart, sputtered onto Mylar® films. The solvent was evaporated and transparent, flexible green films were obtained. The conductivity of these films, measured across the electrodes with a multimeter, was found to be a function of the sulfonic acid content as well as the humidity. With an increase in the sulfonic acid content, the conductivity increased from that of the native soluble polyaniline (ca. $5\times10^{-5}$ S/cm) to 12 S/cm at a ratio of the sulfonic acid-to-aniline units of about 1.5:1 at 50% relative humidity (R.H.). Increasing the ratio above this value did not further increase the conductivity. A plot of the conductivity versus the sulfonic acid: aniline monomer unit ratio for these films is shown in FIG. 1.

The films were placed in a humidity chamber and allowed to equilibrate at 12% R.H. The conductivities of the films were then measured. This was repeated at 0% R.H. Conductivity values for the films at 12% and 0% R.H. are also shown on FIG. 1. Conductivity was seen to decrease significantly as the moisture content of the films decreased. This effect was more pronounced in films having lower values of the sulfonic acid: aniline units ratio.

The films changed from a clear green to an opaque green color upon exposure to water and some of the films substantially disintegrated. It was felt that this was due to leaching of the water-soluble DBSA out of the films.

It is counter-intuitive that the addition of DBSA to the PANDA, which is already saturated with DNNSA as a dopant, would increase the conductivity. Rather, it might be expected to decrease the conductivity due simply to its dilutive effect on the polyaniline. It is believed that the reason that the excess DBSA results in a conductivity increase is that DBSA is extremely hygroscopic and attracts a conductivity-enhancing amount of moisture into the composition. However, water-soluble DBSA would be lost from the composition upon leaching in water.

REFERENCE EXAMPLE 2

This illustrates the leaching of a water-soluble sulfonic acid dopant out of a PANDA film upon exposure to water.

Reference Example 1 was repeated, except that dioctylsulfosuccinic acid (DOSS), (available from Aldrich Chemicals) was added to the xylene solution of PANDA to give a solution 1.25% wt/wt in DOSS. No DBSA was added. The conductivity of a thin film cast across two gold electrodes was $4\times10^{-2}$ S/cm at 30% R.H. The film changed from a clear green to an opaque green upon exposure to water and some of the films substantially disintegrated. It is believed that the change in transparency and loss of strength of the films was caused by the leaching of the DOSS from the films.

EXAMPLE 1

This example illustrates the effect of moisture level on the conductivity of a film of PANDA having varying levels of N-butyl benzenesulfonamide plasticizer.

Figure 2:
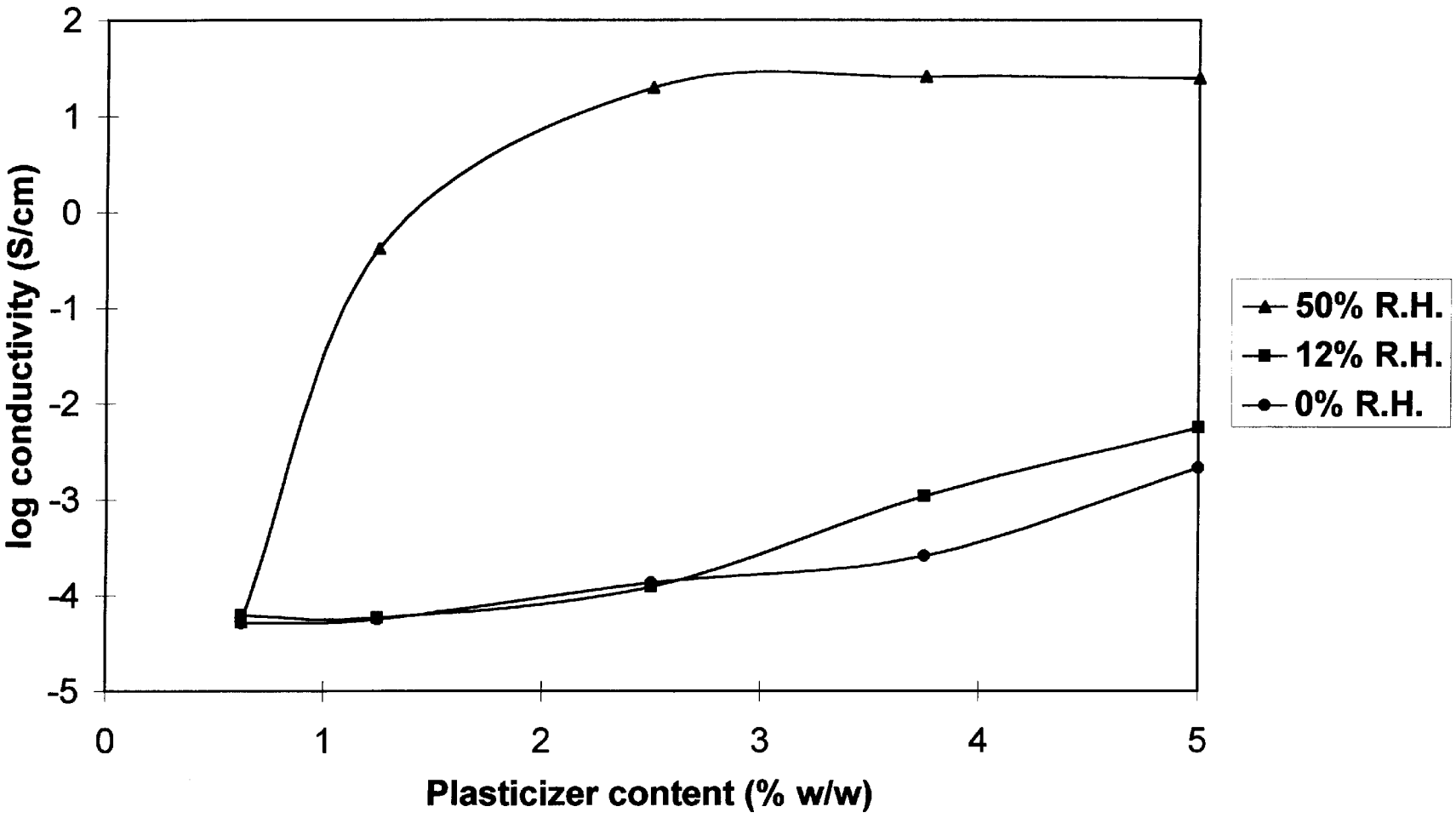
FIG. 2 is a plot of electrical conductivity versus plasticizer content for thin films of the dinonylnaphthalenesulfonic acid salt of polyaniline to which varying levels of Uniplex® 214 plasticizer have been added and the films have been equilibrated at three levels of relative humidity.

A 10% wt/wt solution of PANDA in xylene was prepared as described in Example 1. Uniplex-214 plasticizer (a trade name designation of Unitex Corporation for N-butyl benzenesulfonamide) was added to the xylene solution of PANDA to give solutions having varying concentration of the plasticizer ranging from 0.625% wt/wt to 5% wt/wt. The solutions were clear green with no signs of precipitation and could easily be filtered through a 0.2 micron Teflon® syringe filter. Thin films of these solutions were cast across two gold electrodes as described in Example 1 and transparent green, flexible films were obtained. The films were placed in a humidity chamber and allowed to equilibrate at varying levels of moisture. After the films had equilibrated, the conductivity of the films was measured across the electrodes with a multimeter. A plot of the conductivity of the films versus the level of plasticizer is shown in FIG. 2 at several different levels of R.H. The conductivity of PANDA with no plasticizer was measured at about $5\times10^{-5}$ S/cm.

It is seen that a film having 2.5% wt/wt Uniplex-214 exhibited a conductivity of 25 S/cm at 50% R.H. Increasing the amount of plasticizer above 2.5% wt/wt did not increase the conductivity. At lower levels of humidity (0% and 12%) the effect of the addition of the plasticizer was much less dramatic and the conductivity only increased after over 3.5% wt/wt plasticizer had been added to the compositions. Also, the moisture level seemed to have very little effect on the conductivity of the compositions when the plasticizer was present in an amount below 0.5%. This shows the synergy between the plasticizer and moisture in enhancing the conductivity of the ICP compositions when the plasticizer is present in a conductivity-enhancing amount. This effect of the presence of different levels of moisture on conductivity is reversible in the sense that if a composition that has previously been equilibrated at 50% R.H. is allowed to re-equilibrate in an atmosphere containing, for example, 12% R.H., the conductivity curve will change accordingly as indicated in FIG. 2.

The films were very stable to water and did not show any signs of reduction in conductivity or degradation of appearance even after soaking in distilled water for a day at room temperature.

The uv-vis spectra of the plasticized films were almost identical to the spectra of the native PANDA and no evidence of delocalized free-carrier absorption was observed up to 900 nm.

EXAMPLE 2

This example illustrates the effect of moisture level on the conductivity of a film of PANDA having varying levels of o,p-N-ethyl-p-toluenesulfonamide plasticizer.

Figure 3:
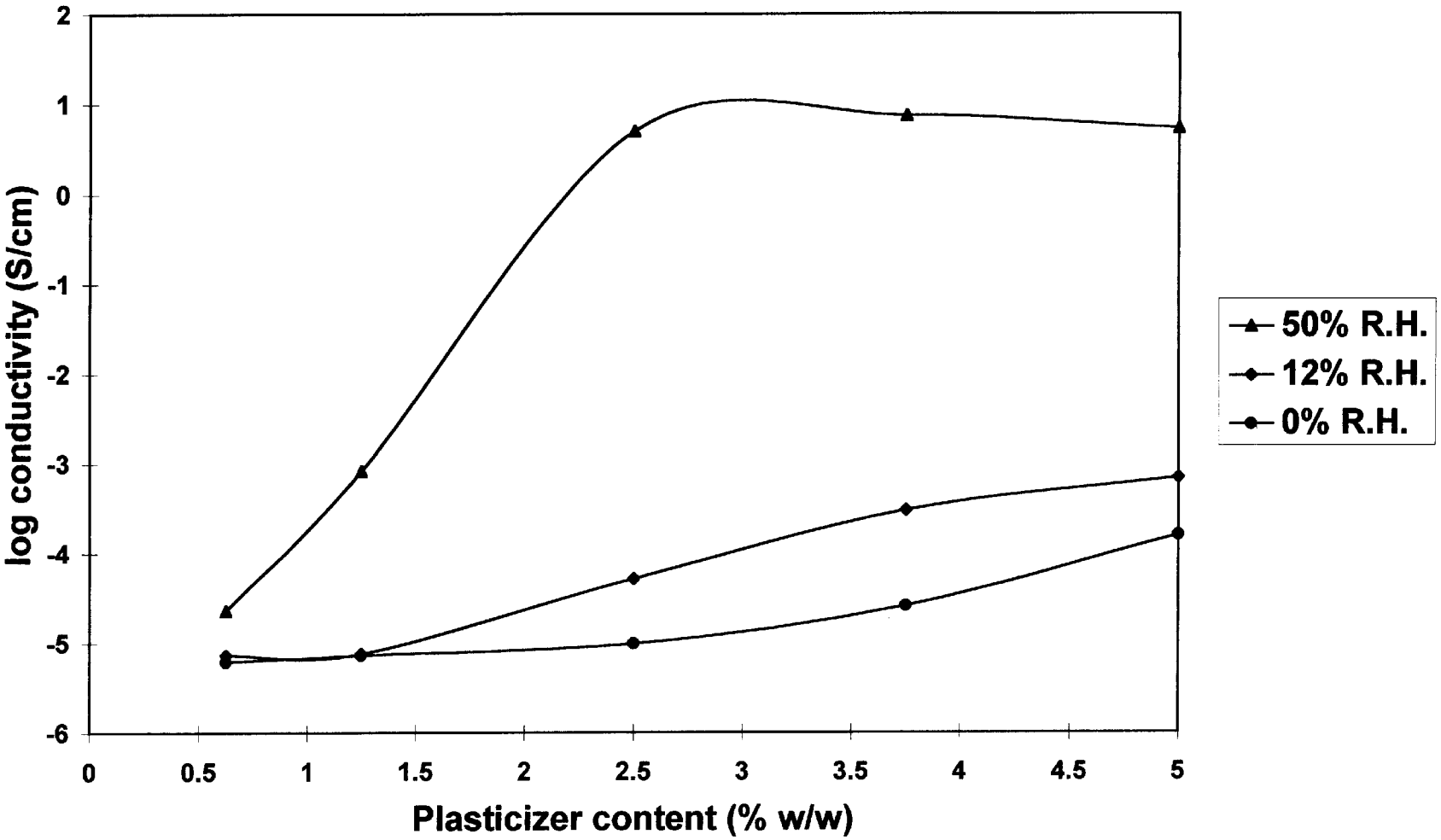
FIG. 3 is a plot of electrical conductivity versus plasticizer content for thin films of the dinonylnaphthalenesulfonic acid salt of polyaniline to which varying levels of Uniplex® 108 plasticizer have been added and the films have been equilibrated at three levels of relative humidity.

The procedure of Example 1 was repeated, except that Uniplex-108 (a trade name designation of Unitex Corporation for o,p-N-ethyl-p-toluenesulfonamide plasticizer) was used as the plasticizer. A plot of the conductivity of films versus the level of plasticizer in the films is shown in FIG. 3 at several levels of R.H. The films having Uniplex-108 demonstrated a similar response to a change in R.H. as the films of Example 1.

EXAMPLE 3

This example illustrates the effect of the presence of a plasticizer and moisture upon the conductivity of a thin film of a blend of PANDA and a thermoplastic phenoxy resin.

Paphen PK-HS40 (a trade name of Phenoxy Associates for a thermoplastic phenoxy resin) at 40% solids, was diluted was diluted with methyl ethyl ketone (MEK) to a ratio of 4:1 phenoxy resin: MEK, wt/wt. PANDA (40% solids in xylene) was also diluted in MEK at a ratio of 1:1 wt/wt. The two solutions were mixed in a 1:1 wt/wt ratio. One part of this mixture was used as a control, and to the second part was added enough Uniplex-214 plasticizer (a trade name of Unitex Corporation for N-butyl-benzenesulfonamide) to give 50% wt/wt plasticizer based on the weight of PANDA. Thin films of these solutions were cast over gold electrodes on Mylar® film and the solvents were evaporated. The films were allowed to equilibrate in a humidity chamber at 30% R.H. The resistance between the electrodes was measured with a multimeter for both films. The PANDA/Phenoxy blend containing plasticizer had a resistance of 270 Ohms, which corresponded to a conductivity of $2\times10^{-2}$ S/cm. The resistance of the blend without the plasticizer was more than the maximum value measurable by the multimeter (20 MegaOhms). Both films were strongly adherent and flexible.

EXAMPLE 4

This example illustrates the effect of the presence of a plasticizer and moisture upon the increase in conductivity of a thin film of a blend of PANDA and a thermoset epoxy resin that also contains a hygroscopic organic acid.

Epoxy resin (13 g), (Epon 1001-T-75, a trade name of Shell Chemical Company for epoxy resin), was mixed with toluene (19 g) and PANDA (4.5 g of 40% solids in xylene). In a separate container, propylene glycol monomethyl acetate (1.8 g), p-toluenesulfonic acid (0.09 g) were mixed with Resimene 755 amine resin curing agent (5.0 g; available from Monsanto Company). The two parts were then mixed together to form a PANDA/Epoxy blend without plasticizer.

The procedure described above was repeated, except Uniplex-214 (0.5 g; a trade name of Unitex Corporation for N-butyl benzenesulfonamide) was added when the two parts were mixed to form PANDA/Epoxy blend with plasticizer. Thin films of both mixtures were cast as described in Example 1 and the films were equilibrated at 30% R.H. in a relative humidity chamber. Conductivities of both films were measured, a value of $5\times10^{-3}$ S/cm was obtained for the blend containing plasticizer and a value of $4\times10^{-4}$ S/cm was obtained for the blend without plasticizer.

The modest increase in conductivity shows that while the plasticizer did increase the conductivity, the size of the increase was not as great as would be expected. It is believed that the reason for this is that the PTSA that is also present in the composition is a hygroscopic dopant that attracts moisture to the composition whether the plasticizer is present or not. However, an organic acid such as PTSA would leach out of the composition if immersed in water. This would either destroy the integrity of the film, or cause the conductivity to decrease, whereas the water-insoluble plasticizer would remain in the film.

In view of the above, it will be seen that the several advantages of the invention are achieved and other advantageous results obtained.

As various changes could be made in the above methods and compositions without departing from the scope of the invention, it is intended that all matter contained in the above description and shown in the accompanying drawings shall be interpreted as illustrative and not in a limiting sense.

What is claimed is:

1. An organically soluble intrinsically conductive polymer composition having enhanced electrical conductivity, comprising an intrinsically conductive polymer salt having a solubility in xylene of at least about 15% wt/wt and a conductivity-enhancing amount of a hygroscopic, water-insoluble plasticizer that is compatible with the intrinsically conductive polymer salt.

2. A composition as set forth in claim 1, wherein the plasticizer is one that, when added to a xylene solution of an organically soluble intrinsically conductive polymer salt in a conductivity-enhancing amount, results in the intrinsically conductive polymer salt remaining in solution without precipitating.

3. A composition as set forth in claim 2, wherein the plasticizer is one that is acidic or neutral.

4. A composition as set forth in claim 3, wherein the plasticizer is a mono-sulfonamide or a bis-sulfonamide.

5. A composition as set forth in claim 4, wherein the plasticizer is a mono-sulfonamide.

6. A composition as set forth in claim 5, wherein the plasticizer is N-butyl-benzene sulfonamide.

7. A composition as set forth in claim 5, wherein the plasticizer is o,p-N-ethyl-p-toluenesulfonamide.

8. A composition as set forth in claim 3, wherein the organically soluble intrinsically conductive polymer salt is the organically soluble intrinsically conductive polymer salt of a hydrophobic organic acid.

9. A composition as set forth in claim 8, wherein the hydrophobic organic acid is a hydrophobic sulfonic acid, hydrophobic carboxylic acid, hydrophobic sulfonate, hydrophobic sulfinic acid, hydrophobic phosphinic acid, hydrophobic phosphonic acid, the salts of such acids, or a mixture thereof.

10. A composition as set forth in claim 9, wherein the hydrophobic organic acid is a hydrophobic sulfonic acid.

11. A composition as set forth in claim 10, wherein the hydrophobic sulfonic acid is dinonylnaphthylenesulfonic acid.

12. A composition as set forth in claim 11, wherein the organically soluble intrinsically conductive polymer salt has a solubility in xylene of at least about 25% wt/wt, or greater.

13. A composition as set forth in claim 2, wherein the hygroscopic, water-insoluble plasticizer increases the conductivity of the composition by a factor of four, or greater.

14. A composition as set forth in claim 2, wherein the hygroscopic, water-insoluble plasticizer increases the conductivity of the composition by one order of magnitude, or greater.

15. A composition as set forth in claim 2, wherein the hygroscopic, water-insoluble plasticizer increases the conductivity of the composition by two orders of magnitude, or greater.

16. A composition as set forth in claim 2, wherein the hygroscopic, water-insoluble plasticizer increases the conductivity of the composition by three orders of magnitude, or greater.

17. A composition as set forth in claim 1, wherein the organically soluble intrinsically conductive polymer composition has a conductivity of at least about $10^{-6}$ S/cm, or higher.

18. A composition as set forth in claim 1, wherein the organically soluble intrinsically conductive polymer composition has a conductivity of at least about $10^{-4}$ S/cm, or higher.

19. A composition as set forth in claim 1, wherein the organically soluble intrinsically conductive polymer composition has a conductivity of at least about $10^{-2}$ S/cm, or higher.

20. A composition as set forth in claim 1, wherein the organically soluble intrinsically conductive polymer composition has a conductivity of at least about 1 S/cm, or higher.

21. A composition as set forth in claim 1, wherein the hygroscopic, water-insoluble plasticizer is substantially retained in the organically soluble intrinsically conductive polymer composition having enhanced electrical conductivity after immersion of said composition in water at ambient temperature for 24 hours.

22. A polymer blend having enhanced electrical conductivity comprising a composition as set forth in claim 1 and a matrix polymer.

23. A polymer blend as set forth in claim 22, wherein the matrix polymer is selected from a thermoset polymer, a thermoplastic polymer, or mixtures thereof.

24. A polymer blend as set forth in claim 23, wherein the thermoset polymer is an epoxy.

25. A polymer blend as set forth in claim 23, wherein the thermoplastic polymer is a thermoplastic phenoxy resin.

26. A method for enhancing the electrical conductivity of an organically soluble intrinsically conductive polymer salt, comprising mixing an intrinsically conductive polymer salt having a solubility in xylene of at least about 15% wt/wt with a conductivity-enhancing amount of a hygroscopic, water-insoluble plasticizer that is compatible with the intrinsically conductive polymer salt, thereby enhancing the electrical conductivity of said organically soluble intrinsically conductive polymer salt.

27. A method as set forth in claim 26, wherein the hygroscopic, water-insoluble plasticizer is mixed with the organically soluble intrinsically conductive polymer salt by forming a solution containing the hygroscopic, water-insoluble plasticizer and the organically soluble intrinsically conductive polymer salt in a solvent and removing all or part of the solvent.

28. A method as set forth in claim 26, wherein the plasticizer is one that, when added to a xylene solution of an organically soluble intrinsically conductive polymer salt in a conductivity-enhancing amount, results in the intrinsically conductive polymer salt remaining in solution without precipitating.

29. A method as set forth in claim 28, wherein the plasticizer is one that is acidic or neutral.

30. A method as set forth in claim 29, wherein the plasticizer is a mono-sulfonamide or a bis-sulfonamide.

31. A method as set forth in claim 30, wherein the plasticizer is a mono-sulfonamide.

32. A method as set forth in claim 31, wherein the plasticizer is N-butyl-benzene sulfonamide.

33. A method as set forth in claim 31, wherein the plasticizer is o,p-N-ethyl-p-toluenesulfonamide.

34. A method as set forth in claim 26, wherein the organically soluble intrinsically conductive polymer salt is the organically soluble intrinsically conductive polymer salt of a hydrophobic organic acid.

35. A method as set forth in claim 33, wherein the hydrophobic organic acid is a hydrophobic sulfonic acid, hydrophobic carboxylic acid, hydrophobic sulfonate, hydrophobic sulfinic acid, hydrophobic phosphinic acid, hydrophobic phosphonic acid, the salts of such acids, or a mixture thereof.

36. A method as set forth in claim 33, wherein the hydrophobic organic acid is a hydrophobic sulfonic acid.

37. A method as set forth in claim 36, wherein the hydrophobic sulfonic acid is dinonylnaphthylenesulfonic acid.

38. A method as set forth in claim 37, wherein the organically soluble intrinsically conductive polymer salt has a solubility in xylene of at least about 25% wt/wt, or greater.

39. A method as set forth in claim 26, wherein the hygroscopic, water-insoluble plasticizer is added in an amount that increases the conductivity of the composition by a factor of four, or greater.

40. A method as set forth in claim 26, wherein the hygroscopic, water-insoluble plasticizer is added in an amount that increases the conductivity of the composition by one order of magnitude, or greater.

41. A method as set forth in claim 26, wherein the hygroscopic, water-insoluble plasticizer is added in an amount that increases the conductivity of the composition by two orders of magnitude, or greater.

42. A method as set forth in claim 26, wherein the hygroscopic, water-insoluble plasticizer is added in an amount that increases the conductivity of the composition by three orders of magnitude, or greater.

43. A method as set forth in claim 26, wherein the organically soluble intrinsically conductive polymer salt has a conductivity of at least about $10^{-6}$ S/cm, or higher.

44. A method as set forth in claim 26, wherein the organically soluble intrinsically conductive polymer salt has a conductivity of at least about $10^{-4}$ S/cm, or higher.

45. A method as set forth in claim 26, wherein the organically soluble intrinsically conductive polymer salt has a conductivity of at least about $10^{-2}$ S/cm, or higher.

46. A method as set forth in claim 26, wherein the organically soluble intrinsically conductive polymer salt has a conductivity of at least about 1 S/cm, or higher.

47. A method as set forth in claim 26, wherein a polymer blend having enhanced electrical conductivity is produced by adding, in addition, a matrix polymer.

48. An organically soluble intrinsically conductive polymer composition having enhanced electrical conductivity, comprising an intrinsically conductive polymer (ICP) salt having a solubility in xylene of at least about 15% wt/wt throughout which ICP salt is evenly distributed a conductivity-enhancing amount of a hygroscopic, water-insoluble plasticizer which is compatible with the intrinsically conductive polymer salt.

* * * * *